United States Patent [19]

Gianelli

[11] Patent Number: 5,044,142

[45] Date of Patent: Sep. 3, 1991

[54] PACKAGING METHOD AND APPARATUS

[75] Inventor: Gian C. Gianelli, Milan, Italy

[73] Assignee: W. R. Grace & Co. - Conn., Duncan, S.C.

[21] Appl. No.: 587,499

[22] Filed: Sep. 20, 1990

[30] Foreign Application Priority Data

Sep. 21, 1987 [GB] United Kingdom ..... 8722201

[51] Int. Cl.[5] ..... B65B 53/06; B65B 31/02

[52] U.S. Cl. ..... 53/434; 53/442; 53/512; 53/557

[58] Field of Search ..... 53/434, 442, 512, 557, 53/86, 95

[56] References Cited

U.S. PATENT DOCUMENTS 4,204,379 5/1980 Mugnai et al. ..... 53/512
4,236,672 12/1980 Koeberle ..... 53/512 X
4,418,512 12/1983 Johnson ..... 53/512 X

FOREIGN PATENT DOCUMENTS 2152897 8/1985 United Kingdom .
2164911 4/1986 United Kingdom .

*Primary Examiner*—Horace M. Culver
*Attorney, Agent, or Firm*—William D. Lee, Jr.; Mark B. Quatt; John J. Toney

[57] ABSTRACT

A package is steam-shrunk while subjected to a substantially constant sub-atmospheric pressure generated by a suction fan 22 operating at the same time as a steam generator 13 maintaining the prevailing pressure within a chamber interior 20 at sub-atmospheric pressure in the presence of steam. The low pressure of the steam ensures that its temperature is well below the boiling point of water and avoids thermal damage to the material of a container 12 being shrunk.

3 Claims, 4 Drawing Sheets

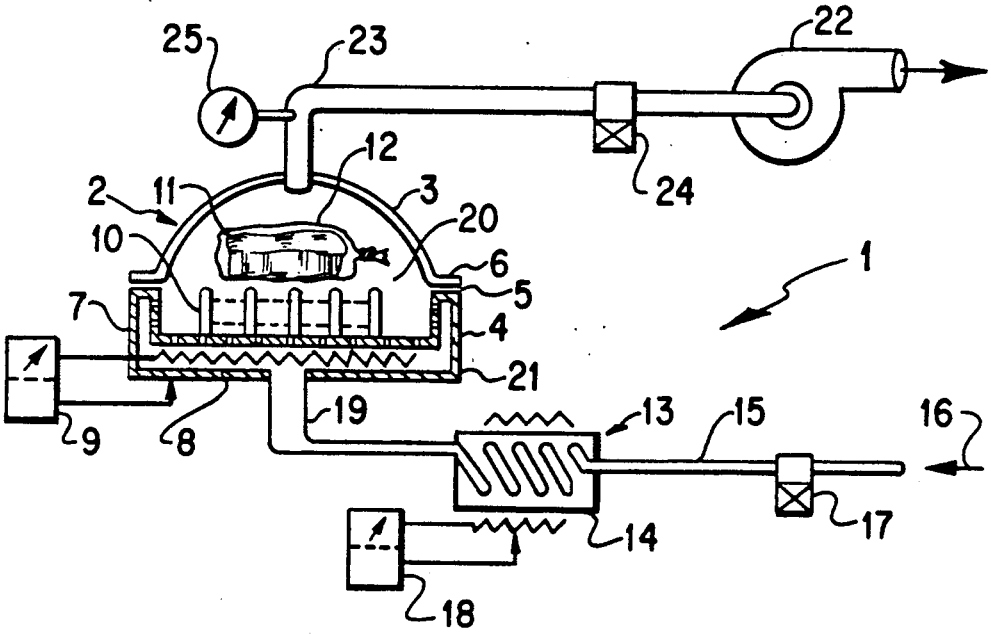
FIG. 1
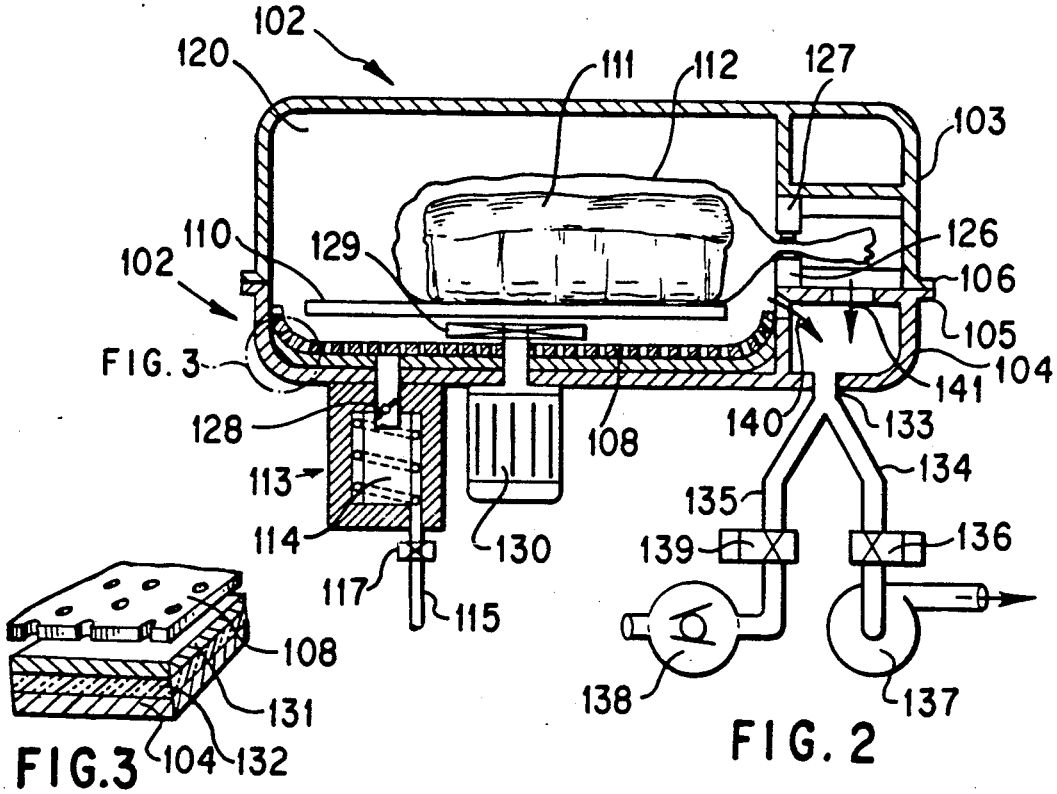
FIG.3
FIG. 2

PACKAGING METHOD AND APPARATUS

This application is a continuation of application Ser. No. 07/241,437 filed on Sept. 7, 1988, now abandoned.

The present invention relates to the packaging of articles in flexible containers, for example, pouches, made of heat-shrinkable material which can be caused to contract tidily around the product article being packed, leaving a sub-atmospheric pressure within the pack.

GB-A-2078658 discloses a vacuum packaging cycle in which the extraction of air from within a vacuum chamber proceeds while the neck of a container of flexible heat-shrinkable material is constricted so as to allow only limited removal of air from within the package, causing the container material to balloon away from the product while residual air within the chamber is both heated and circulated to impart shrinking heat to the package. The heat transfer to the container walls proceeds due to conduction from the moving air flow but requires a relatively long cycle time.

GB-A-2094745 discloses a modification in which the removal of gas from within the container in the chamber is impeded while shrinking heat is applied to the container by radiant heating, so that again the gas remaining within the container maintains the container wall clear of the product such that equilibrium between the shrinking forces in the container material and the pressure differential between the interior and the exterior of the closed container during evacuation of the chamber within which the container is placed results in the desired ballooning configuration during the application of shrinking heat to the container, to allow subsequent release of the air or other gas from within the flexible container to permit the desired tidying shrink action.

U.S. Pat. No. 4567713 discloses a vacuum chamber packaging process in which when, during the cycle, the chamber evacuation stops the venting of the chamber occurs by means of introduction of steam, initially while the pressure is low but also continuing during the build-up of pressure The steam is superheated before entry into the chamber but condenses onto the container, thereby heating the container with the latent heat of condensation and permitting the container to shrink into contact with the enclosed product We now propose to provide a modified process and apparatus which enhances the appearance of the pack as compared with that of U.S. Pat. No. 4567713, in that the likelihood of fogging of the container is reduced and the efficiency of heat transfer is maintained.

Accordingly, one aspect of the present invention provides a method of heat-shrinking a package, comprising: placing a product in a container; reducing the pressure prevailing on the surface of the container, contacting that surface with steam while maintained at a sub-atmospheric pressure in order to impart shrinking heat to the container wall by virtue of the released latent heat of condensation of the sub-atmospheric pressure steam; maintaining the sub-atmospheric pressure on said surface of the container during the steam shrinking step; and subsequently discontinuing the flow of steam and restoring the pressure.

A further aspect of the present invention provides apparatus for steam shrinking a package, comprising: a vacuum enclosure within which the package is to be shrunk; means for generating steam and for introducing it into said enclosure; means operable while the steam generator is in operation, for extracting air and/or steam from the enclosure to maintain a substantially uniform sub-atmospheric pressure in the steam-filled enclosure around the package; and means for cycling the apparatus to extract residual steam from the exterior of the container before the enclosure is opened.

The invention further provides a pack made by the process and/or the apparatus defined above.

In order that the present invention may more readily be understood the following description is given, merely by way of example, with reference to the accompanying drawings in which:

FIG. 1 is a schematic view of a manual apparatus for carrying out the process of the present invention;

FIG. 2 is a schematic side elevation of a semi-automated first embodiment of apparatus for carrying out the invention;

FIG. 3 is a detail of the chamber shown in FIG. 2;

Figure 4:
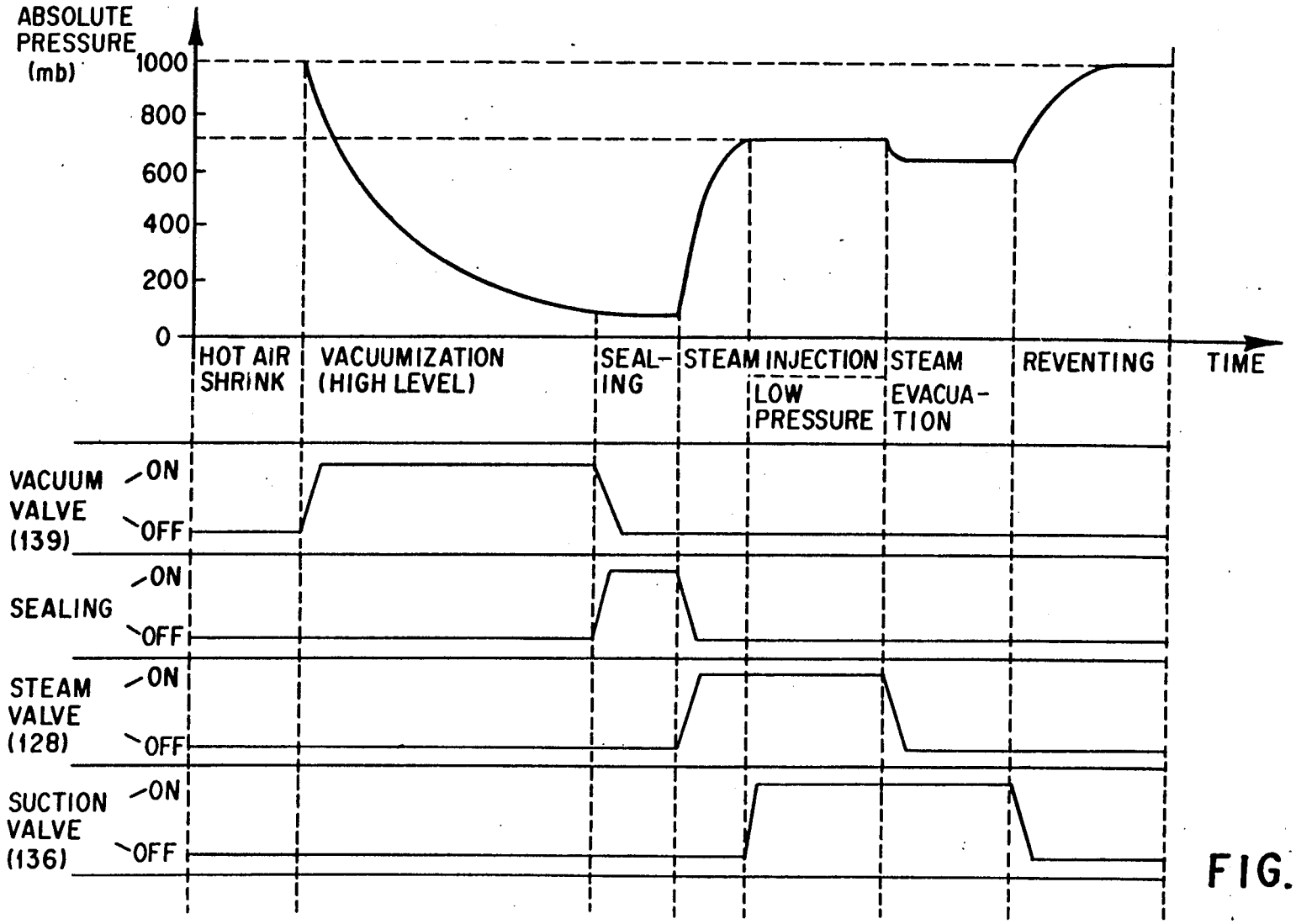
FIG. 4 is a cycle timing diagram depicting the operating cycle of the apparatus of FIG. 2.

The manual apparatus 1 of FIG. 1 includes a vacuum chamber 2 comprising an upper chamber part 3 which is able to be lifted and lowered for opening the chamber, and a fixed lower chamber part 4 which is of hollow walled construction and has an upper edge 5 sealing against a flange 6 of the upper chamber part 3. The interior of the lower chamber part; 4 thus defines a hollow space 7 enclosing an electrical resistance heater 8 controlled by a thermostatic temperature controller 9.

The upwardly open general configuration of the lower chamber part 4 provides for a horizontal grid 10 to support a product 11 loaded in a flexible container, in this case a bag 12, of heat-shrinkable material.

The support grid 10 is formed of several generally vertical polytetrafluorethylene plates, or plates coated with strips of polytetrafluorethylene, mounted on horizontal metal studs in order to prevent the bag from coming directly into contact with the hot inner wall of the double wall lower chamber part 4.

Steam is introduced to the lower chamber part 4 by way of a steam generator 13 comprising a water-heating heat-exchanger 14 surrounding a water line 15 through which the flow of water along the direction of arrow 16 is controlled by a valve 17. When steam generation is required the valve 17 is opened, and when the valve 17 closes steam ceases to be generated and any residual water vapor in the line 15 passes into the hollow inner space 7 of the lower chamber portion 4.

The water control valve 17 is controlled by a timer which can be adjusted, in order to allow a given quantity of water to pass through the steam generator for generation of an adjustable given quantity of steam.

The temperature of the heat-exchanger 14 is controlled by a thermostatic controller 18, to any desired temperature.

The steam line 19 from the steam generator 13 opens into the hollow interior space 7 of the lower chamber part 4 and from there escapes into the interior 20 of the vacuum chamber by way of apertures 21 in the inner wall of the lower chamber part 4.

Partial vacuum is maintained in the space 20 within the chamber 2 by way of a suction fan 22 linked to the chamber interior 20 by way of an air extraction line 23 including an air control valve 24 and a pressure gauge 25.

The suction fan has the capacity to maintain the pressure within the chamber at around 700 millibars absolute pressure. In this case the suction fan is a side channel blower.

In order to explain the invention in more detail, one complete cycle of the apparatus shown in FIG. 1 will now be described.

While the apparatus is operating on a continuous basis the temperature of the water heater 14 of the steam generator 13 will be maintained constant by virtue of the thermostatic controller 18; the temperature of the heating element 8 within the double wall lower chamber portion 4 is also maintained constant.

Initially the product 11, which has been loaded into the bag 12 under vacuum and the bag has then been closed to seal it, is placed on the support grid 10 while the upper chamber portion 3 is in elevated configuration. The solenoid-operated air control valve 24 is then opened and the suction fan 22 is operated long enough to reduce the chamber pressure from 1000 millibars to 600 millibars absolute pressure, as can be verified by the pressure gauge 25. At the desired reduced pressure (in this case 600 millibars), the solenoid-controlled water valve 17 is opened and remains open for a pre-set time interval in order to allow small quantity of water to reach the water heater 14. In the water heater, the water evaporates to form steam which then becomes sucked into the inner space 7 of the lower chamber part 4 where it contacts the heater 8 and becomes further heated as it passes towards and then through the holes 21 which allow the thus superheated steam to emerge into the interior space 20 of the chamber. At this stage the suction fan 22 is, as indicated above, still operating and maintains the pressure at from 650 to 700 millibars.

At the desired instant the timer closes the solenoid-operated valve 17 to stop the feed of water to the water heater 14, thus the remains of the steam shot will be sucked into the chamber interior 20 and around the exterior of the bag 12. The bag surface is at this stage relatively cool, in that it adopts the temperature of the enclosed product 11 which has a relatively high thermal capacity, so that the steam then condenses on the bag surface, releasing the latent heat of vaporization which imparts a considerable quantity of heat to the bag without subjecting the exterior of the bag to an unduly high temperature which would damage the heat-shrinkable material of the bag. In the present example it is envisaged that the temperature of the steam within the chamber cannot exceed 90° C., and consequently the temperature of the bag material will be a few degrees lower than this.

Any excess steam injected into the chamber interior 20 will be extracted by the suction fan working to maintain the chamber pressure between 650 and 700 millibars, thereby maintaining the low temperature of the steam in the chamber (90° C.).

When all of the injected water has evaporated, the suction fan 22 removes the residual uncondensed steam and reduces the chamber pressure once more to 600 millibars.

After a short interval, for example of half a second, the solenoid-operated air valve 24 is closed and the chamber is then revented to atmosphere by means of a vent line, not shown.

Once the chamber venting has been completed, the upper chamber portion 3 is lifted and the air valve 24 re-opened so as to allow the suction fan 22 to extract any residual steam and avoid its dispersal into the room around the vacuum chamber.

At this stage the shrunk pack comprising the product 11 and the bag 12 can be removed and the next bagged product can be inserted for commencement of the next subsequent machine cycle.

It will of course be appreciated that this manual apparatus incorporates not only the means for adjusting the time interval during which the water control valve 17 is open, but also means for adjusting the temperatures of the thermostatic controllers 9 and 18 controlling the chamber heater element 8 and the water heater 14. Furthermore, the operation of the air control valve 24 can be dependent upon the pressure indicated by the pressure gauge 25 in order to control the air pressure to the ranges described above.

Tests made using the apparatus of FIG. 1 have shown that the product has a tidy final appearance which is equally as good as that produced by hot water shrink of a sealed bag (the conventional way of achieving maximum input of heat to a bag in minimum time).

In a series of texts, the worst values of residual condensed water on the surface of the pack after steam shrinking were 2.5 times less than the water residue on the same type of pack after shrinking in hot water. There is thus less need for subsequent drying which would otherwise extend the packaging cycle time still further.

The water consumption on this series of tests was found to be 10 cc per cycle, although this will increase when larger chambers are used. Nevertheless, it is an advantage that this relatively low consumption occurs, and that the water supply was acceptable without requiring treating with water demineralizing/deionizing filters.

The small quantity of water consumed also indicates that the heat energy required to generate steam from that water is relatively low as compared with the energy required to maintain a large water shrink tank at shrinking temperatures.

A first automated embodiment of the apparatus, for both evacuating the bag before closing and also shrinking the bag, is illustrated in FIGS. 2 and 3 in which those components which correspond to components illustrated in FIG. 1 are indicated by the same reference numeral increased by 100.

The chamber 102 comprises a fixed lower chamber part 104 and an upper chamber part 103 which is driven, by means not shown, for lifting and lowering in order to permit a product 111 inside an unclosed bag 112 to be introduced into the chamber when open. The bagged product 111, 112 may, for example, be introduced into the chamber by being driven on a leftwardly moving conveyor belt (not shown) which deposits the bagged product 111, 112 on the product support plate 110 after the bagged product has entered through the right hand side of the chamber.

The flanges 105 and 106 of the lower and upper chamber parts 104 and 103, respectively, mark the point of separation of the two parts of the chamber as it opens.

The neck of the bag 112 is in this embodiment automatically sealed as the chamber closes, by virtue of a fixed lower sealing bar 126 against which a movable upper sealing bar 127 moves as the upper chamber part 103 descends. Once the chamber is closed, and after preliminary partial evacuation, the heat sealing elements of the bars 126 and 127 are energized in order to provide a flat line weld transversely across the bag mouth.

The steam generator 113, in this embodiment, includes a water heater 114 which heats water from a supply line 115 controlled by a solenoid-activated control valve 117, causing that water to evaporate and before passing into the chamber interior 120 by way of a butterfly type of steam valve 128.

The circulation of air and steam within the chamber is effected by means of a fan rotor 129 driven by a motor 130.

In this embodiment the chamber includes a foraminous plate 108 positioned above the floor of the lower chamber part 104 to allow the steam to enter the chamber interior 120. This plate, serving as a diffuser for the steam to ensure uniformity of the steam cloud in the chamber interior 120 is kept hot by heating elements 131 (FIG. 3) in order to avoid condensation of the steam as it passes through the plate 108. FIG. 3 also illustrates thermal insulation 132 between the heating elements 131 and the chamber wall 104.

Air and, when appropriate, steam are extracted from the chamber interior 120 through a conduit 133 having two branches 134 and 135.

The branch 134 is a suction conduit including a suction valve 136 capable of isolating a suction fan 137 from the chamber interior 120, or communicating it with the chamber interior, as desired.

The branch 135 is a vacuum conduit communicated with a vacuum pump 138 by means of a vacuum valve 139.

When the chamber interior is to be evacuated in order to induce a vacuum in the space between the product 111 and the bag wall 112, the vacuum pump 138 is operated with the vacuum valve 139 open so as to draw the required degree of vacuum in the chamber interior 120, by virtue of the gas flow depicted by the arrow 140, and within the interior of the bag 112, by virtue of the extraction of gas following the path indicated by the arrow 141.

At the appropriate time, when steam is to be extracted from the chamber prior to chamber venting, in order to recover the steam and avoid the unpleasant effects of the steam being discharged into the packing room atmosphere, the suction fan 137 is operated with the suction valve 136 open.

In order to illustrate the operating cycle of the machine of FIGS. 2 and 3 in more detail, FIG. 4 presents the timing diagram of a typical cycle.

The top graph in FIG. 4 clearly illustrates the pressure variations with time. The second graph shows the opening and closing of the vacuum valve 139. The third graph shows the energization of the sealing bars 126 and 127. The fourth graph shows the opening and closing of the steam valve 128. The fifth graph shows the opening and closing of the suction valve 136.

As can be seen from the drawing, the pressure in the chamber interior 120 is initially held at substantially atmospheric value during an initial hot air shrink phase when the impeller 129 causes circulation of air heated by the residual temperature of the heating elements 131 and the foraminous diffuser plate 108 to pass over the exterior of the bag 112 to initiate shrinkage. During this time the bag neck is held substantially closed by the pressure of the bars 126 and 127. The yieldability of the bag neck may, for example, be achieved by the addition of a further pair of clamping bars just downstream of the sealing bars 226 and 227, exerting a yieldable clamping effort, by virtue of biasing springs holding those clamping bars (not shown) together, and such that when the pressure differential between the interior of the bag 212 and the chamber internal volume 220 surrounding the bag reaches a given value the clamping action yields to allow the trapped gas in the bag to escape to evacuate the bag interior. This bag clamping causes the trapped atmosphere within the bag 112 and around the product 111 to resist shrinking of the bag and to hold the material of the bag 112 away from contact with the cool product 111 until the temperature of the bag material has been allowed to build-up to some extent. During this initial heat shrinking phase the various valves 128, 136 and 139 are all held closed.

During a second phase the vacuum valve 139 is opened and the vacuum pump 138 operated so as to extract the hot air from within the chamber material 120 and within the bag 112 (by yielding of the above-mentioned bag clamping action) to reduce the residual pressure in the chamber to approximately 10% of atmospheric pressure. When this low pressure has been attained, the vacuum valve 139 closes and the electric welding heaters of the bars 126 and 127 are energized as shown in the third graph in FIG. 4.

The next stage is the steam generation phase resulting from opening of the water valve 117 to allow the water to enter the water heater 114 to be vaporized and to pass the now open valve 128 in the form of steam which is then diffused into the chamber interior 120 by way of the apertures in the foraminous plate 108. During this stage the pressure in the chamber rises, but to a value substantially 70% of atmospheric.

This intermediate pressure is maintained during a subsequent phase when, due to the opening of the suction valve 136 and the operation of the suction fan 137, the pressure remains stable at substantially 700 millibars.

At the end of the steam generation phase the suction valve 136 remains open after the steam valve 128 has closed, and as a result the pressure reduces slightly to substantially 600 millibars. This reduced pressure is then maintained by virtue of the operation of the suction fan 137, possibly in conjunction with pressure-responsive control means such as a controllable throttling of the valve 136.

Finally, the chamber is vented by closing of the suction valve 136 and by raising the upper chamber portion 103 to open the chamber.

Now, once the vacuum cycle has been completed, the tidy-shrunk pack 111, 112 can be delivered from the chamber 102 by conveying it leftwardly towards a delivery conveyor, not shown.

As will be appreciated, the embodiment of FIGS. 2 and 3 is particularly convenient where closing of the bag is to be by way of a hot weld seal line.

Figure 5:
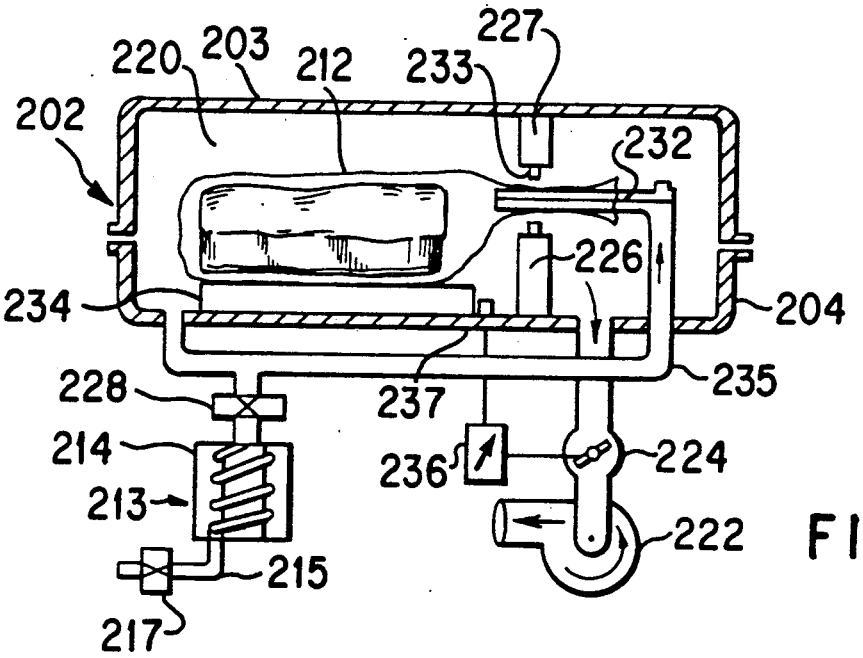
FIG. 5 is a schematic side elevation of a second possible apparatus for carrying out the invention in an automatic manner.
Figure 6:
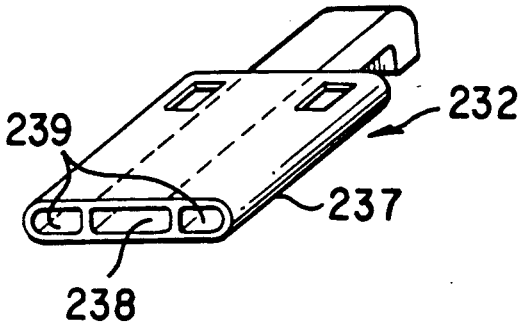
FIG. 6 is a detail of the evacuation nozzle of FIG. 5.

An alternative embodiment of automated apparatus is shown in FIGS. 5 and 6 in which the "suction nozzle" principle is used. Those components of FIG. 5 which are also shown in FIG. 1 are denoted with the same reference numeral increased by 200.

In the alternative embodiment shown in FIG. 5 the chamber 202 has the upper chamber portion 203 once again lifted mechanically in timed relation to the operating cycle of the machine.

As with the embodiment of FIGS. 2 and 3, there is a fixed sealing bar set 226 in the fixed lower chamber part 204 and a movable upper sealing bar set 227 which is carried by the movable upper chamber part 203 for movement towards and away from the bag neck. However, in this particular embodiment there is additionally means for moving the upper sealing bar 233 vertically relative to the upper chamber part 203 because initially an air extraction nozzle 232 is positioned inside the mouth of the bag 212 in the early part of the chamber evacuation phase.

The bag 212 rests on a support plate 234 coated with polytetrafluorethylene in order to avoid the bag sticking to the plate.

As with the earlier embodiments, the steam generator 213 uses a water heater 214 operating on a water supply line 215 having a solenoid-operated water control valve 217. There is furthermore a steam control valve 228 controlling the admission of steam to not only the chamber interior 220 but also the nozzle (by way of a nozzle steam line 235).

A pressure responsive control unit 236 is linked to a pressure transducer 237 on the floor of the lower chamber part 204 and controls the air extraction valve 224 between the chamber interior 220 and the suction fan 222.

The nozzle 232 is shown in more detail in FIG. 6 and comprises a generally flat tubular structure divided into three longitudinally extending side-by-side passages of which one (in this case the central passage) is a steam injection passage 238 while the other two lateral passages 239 are open at both ends so as to communicate the interior of the bag 212 with the exterior for removal of air from within the bag 212.

The operation of the apparatus of FIGS. 5 and 6 is as follows:

Initially, starting with the upper chamber portion 203 raised, and the product support plate 234 vacant, an open-mouthed bag 212 enclosing a product 211 is introduced into the chamber and placed on the product support plate 234. The neck of the bag is arranged around the generally flat end portion of the nozzle 232, just above the lower heat sealing bar set 226. This may, for example, require the nozzle 232 to be movable to an out of the way position to allow the bag neck to be arranged carefully over the lower heat sealing bar set and then swung back into position to enter the bag neck to arrive at the configuration shown in FIG. 5.

The vacuum chamber is then closed by lowering of the upper chamber part 203.

Once the chamber has been closed the suction fan 222 is energized and the air extraction valve 224 is opened by means of a controller 236. The suction fan 222 thus reduces the pressure in the chamber interior 220.

The water feed valve 217 is then opened to allow water to flow into the heater 214 and the steam inlet valve 228 is opened to allow simultaneous ingress of the generated steam into the bag interior by way of the steam injection passage 238 of the nozzle 232 and into the chamber interior 220 around the bag exterior. The contact of the low pressure steam with both the interior and the exterior surfaces of the bag walls efficiently transfers heat to the bag material to promote shrinking, but at a temperature which is significantly less than the boiling point of water (indeed less than 90° C.) because of the sub-atmospheric pressure prevailing in the chamber at the time of steam injection.

This sub-atmospheric pressure is maintained by continued operation of the suction fan 222 throughout the period of injection of steam.

At a desired instant the steam injection nozzle 232 is automatically withdrawn, by means not shown, until its tip has just passed the sealing bars 226 and 227 and the heating element 233 of the upper sealing bar set 227 is energized as the bar 227 is driven downwardly into contact with the corresponding lower sealing bar 226 to close the bag. At this point steam injection to both the chamber interior 220 and the bag interior 212 will have terminated. The condensing of the steam on the interior of the bag 212, which assists transfer of the latent heat of condensation to the bag to promote shrinkage, has the important effect that the condensation of the steam reduces to about 1/1700 the volume of the contents surrounding the product and within the closed bag so as to suck the bag material back more effectively onto the surface of the product 211, and to be free to shrink back, particularly as the chamber is vented.

Once venting of the chamber has been completed, the upper chamber portion 203 can be lifted to open the chamber to allow removal of the tidy-shrunk package and the valve 224 opened in order to clear the chamber of residual steam which might otherwise escape into the packaging room.

Figure 7:
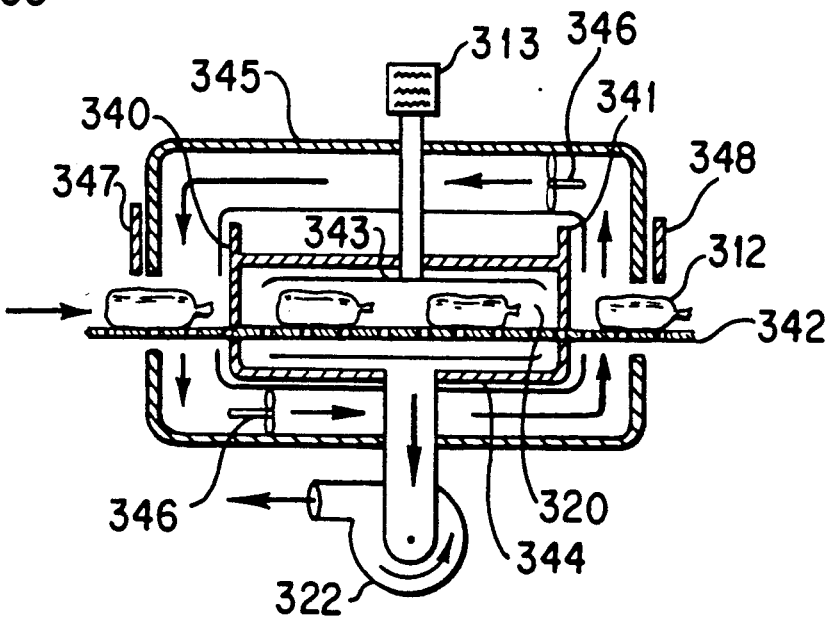
FIG. 7 is a schematic view of a third possible apparatus for carrying out the invention.

An alternative embodiment shown in FIG. 7 has provision for facilitated introduction and removal of the bagged product and has those components which are in common with the FIG. 1 embodiment increased by 300.

The chamber interior 320 is defined within an enclosure including inner chamber doors 340 and 341 at the inlet and outlet ends, respectively of the chamber, and through which loaded bags. 312 are carried on a foraminous support element 342, in this case an endless conveyor element which may be formed of either a stranded belt or rods. A steam generator 313 communicates with the top of the chamber interior 320 and has the steam therefrom distributed from within the chamber 320 by means of an upper baffle 343. A similar lower baffle 344 ensures that the air extraction current is distributed over the entire floor area of the chamber interior 320 as the extracted air is withdrawn by the suction fan 322.

Around the exterior of the inner chamber space 320 is an air circulation conduit 345 which allows air to be heated and circulated by means of fan heaters 346 so as to pass both over the entering loaded bag 312 before they arrive at the chamber inlet door 340, and around the exterior of the discharging bags 312 after they have left the discharge chamber door 341. The air circulation conduit 345 thus provides a high velocity air curtain to preserve the low pressure in the chamber interior 320.

In order to conserve air in the outer circulation conduit 345, there is an outer sliding door 347 at the inlet end and a further outer sliding door 348 at the discharge end. There is thus a type of air lock formed at the inlet, between the doors 347 and 340, and at the outlet, between the doors 341 and 348.

The conveyor surface 342 may operate continuously if there is some means present for allowing the conveyor element to pass under the doors 340 and 341 in their substantially closed position. Alternatively the conveyor surface 342 may be advanced intermittently so that while the surface 342 is stationary one of the two doors 347 and 340 of the inlet and one of the two doors 341 and 348 of the outlet end may be closed while the other is opened because of the presence of a bagged product there under, as shown in FIG. 7.

One possibility for controlling the doors 340, 341, 347 and 348 is illustrated in FIGS. 8*a*, 8*b*, 8*c*, and 8*d* which only illustrate the inlet doors 340 and 347 but where the operating principle can be the same for the outlet doors 341 and 348.

At the foot of each of the doors is a horizontal photoelectric beam generated by a transmitter 349 at one side of the product feed path and a receiver at the other side of that path and control circuitry is provided which will cycle the door in question to rise at any stage when the beam is interrupted, and to continue that rising movement until the beam is restored. The beam is positioned somewhat in advance of (i.e. to the left of) the foot of the door so as to ensure that the beam becomes interrupted before any product article moving towards the door becomes impeded by the presence of the door itself.

Because of the fact that the photoelectric detector and emitter are carried by the respective door 340, 341, 347 and 348, the door has a tendency to follow the profile of the article in that, as soon as the door has lifted sufficiently to raise the beam above the upper surface of the product article, that door will stop rising and will be driven to descend until the beam is once again interrupted.

Figure 8A:
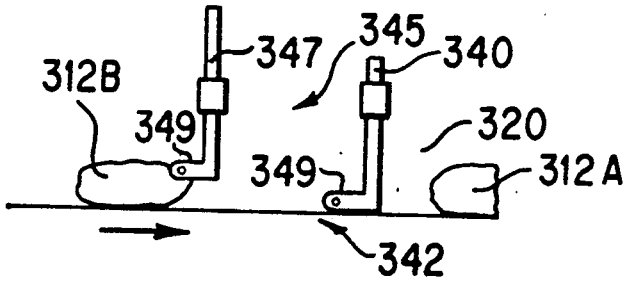
FIGS. 8A TO 8D show the operation of the doors of the apparatus of FIG. 7, and illustrate the automatic control of the doors.

FIG. 8*a* shows the outer door 347 beginning to open while the inner door 340 remains in its substantially closed position (i.e. just clear of the surface of the product support surface 342).

Figure 8B:
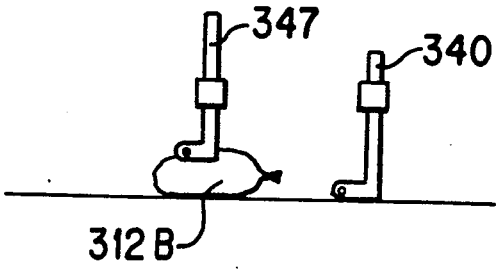

In FIG. 8*b* the door 347 has risen just far enough to allow the product article 312*b* to pass there below, but the inner door 340 remains substantially closed.

Figure 8C:
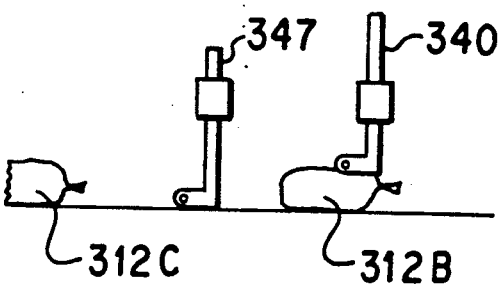

In FIG. 8*c* the product article 312*b* has passed the outer door 347 which has now once again closed because the beam is no longer interrupted, and has begun to pass under the inner door 340 which has risen automatically in the manner described above for door 347.

Figure 8D:
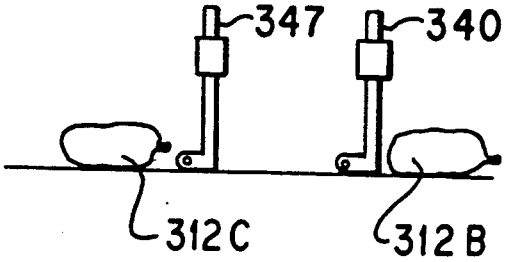

Finally, the configuration shown in FIG. 8*d* is the one in which the two doors 340 and 347 are substantially closed after the product 312*b* has just entered the inner chamber portion and before the next product 312*c* passes the outer door 347 to enter the "air lock" space 345.

Although not shown in FIG. 7, there may be means linking the interior of the air circulation conduit 345 with the air extractor fan 322 for the chamber interior 320, in order to ensure that the pressure of the air circulating within the air circulation conduit 345 is lower than atmospheric, thereby limiting the amount of leakage of air into the low pressure steam treatment chamber 320 at the center of the apparatus, and supplementing the barrier function of the doors 340, 341, 347 and 348 which never quite close.

The apparatus of FIGS. 7 and 8 operates in the following manner:

Initially all four doors 340, 341, 347 and 348 are closed.

The door 347 opens to an extent sufficient to allow the first product to pass, and the doors 340 and 341 are meanwhile almost closed, i.e. they are open sufficiently to allow the continuously advancing support surface 342 to pass thereunder. This movement of the support surface 342 introduces a bagged product into the FIG. 5 position under the open inlet door 347.

The circulating air in the conduit 345, being preheated, carries out an initial pre-shrink phase on the entering sealed bag 312. Very soon thereafter, the door 340 opens slightly to allow the product support surface 342 to carry the first product thereunder. As soon as the bagged product has cleared the underside of the outer inlet door 347 this door substantially closes to allow the pressure of the air within the air circulating conduit 345 to begin to drop towards the low pressure in the chamber interior 320. Shortly after, the closed door 347 will be just clear of the support surface 342 while the door 340 is open to an extent sufficient to allow the product to enter the chamber interior 320. Once the product article has cleared the inner door 340, and is totally within the chamber interior 320, the door 340 may close fully for a time, and the steam generator 313 may be operated, in order to circulate steam within the chamber interior 320 to achieve shrinking but simultaneously with maintenance of the low pressure within the chamber interior 320 by virtue of operation of the suction fan 322.

Shortly afterwards, the next product article 312 will begin to pass under the door 347 which must for this reason begin to open automatically, and gradually the previously described sequence will repeat until there are product articles at the various positions shown in FIG. 7 of which: (a) the left hand most is being pre-shrunk as it emerges into the hot air circulation conduit 345, (b) the right hand most is being post-shrunk by the hot air in the air circulation conduit 345 as that product emerges from the circulation conduit, and meanwhile (c) the two central products within the chamber interior 320 are being more intensively shrunk by virtue of the low pressure steam circulating within the chamber interior 320.

It will of course be appreciated that the apparatus of FIG. 7 is, as with the embodiment of FIG. 1, simply a mechanism for shrinking an already sealed bag but with minimum energy consumption. The difference between the process employed in FIGS. 1 and 7 and that of the prior art, for example in U.S. Pat. No. 3,567,713, is that the generation of steam coincides with the extraction of gas from within the chamber, with the result that the generated steam is withdrawn by the suction fan whereas in the prior art the steam was used as a venting medium. It has been found, however, that by maintaining the pressure of the steam at well below atmospheric it is possible to maintain its temperature well below the boiling temperature of water and thus to avoid any deleterious effects on the heat-shrinkable plastic material of the packaging bag.

Figure 9:
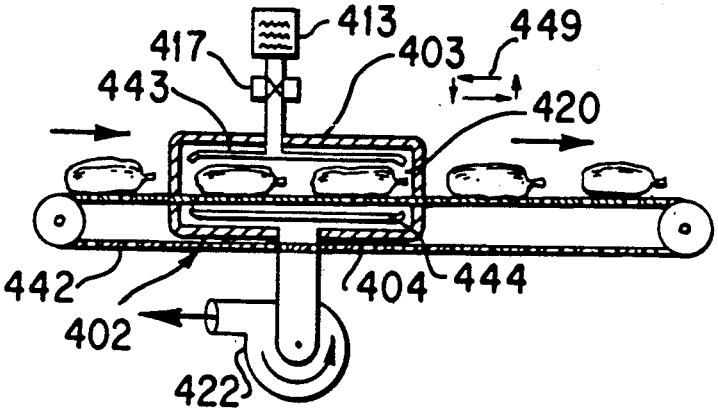
FIG. 9 is a schematic illustration of a variant of the apparatus of FIG. 7.

The apparatus shown in FIG. 9 is very schematically illustrated and includes the steam generator 413 and steam control valve 417 operating in conjunction with a two-part chamber comprising the upper chamber part 403 and the lower chamber part 404 both of which, in this embodiment, are movable laterally as well as able to be opened vertically. The chamber parts each include steam-distributing and flow-controlling baffles 443 and 444, respectively, in order to homogenize, as far as possible, the flow of low pressure steam induced through the chamber interior 420 by virtue of the operation of the suction fan 422.

As with the embodiment of FIGS. 7 and 8, there is a foraminous product-support surface 442 which in this case comprises an endless conveyor belt whose upper run cooperates with the chamber 402.

The path of movement of the upper chamber part 403 is illustrated schematically by a rectangular set of vector arrows 449 from which it can be seen that when the chamber 402 is closed the upper chamber part 403 is moving rightwardly parallel to the direction of the upper run of the conveyor surface 442, after which the chamber part 403 rises to open the chamber and to free the heat-shrunk bagged products for further advance along the path of the conveyor surface 442, followed by which the upper chamber part 403 moves leftwardly back to its start position ready to descend over the next two product articles for steam-shrinking them.

Conversely, the lower chamber part 404 moves rightwardly, then descends, then moves leftwardly, and then rises again to close around the next two product articles during these four operating movements of the upper chamber part 403 illustrated by the vector arrows 449.

The cycling of the activation and de-activation of the steam generator 413, the steam control valve 417, and the air extractor fan 422 are much as described in connection with the FIG. 1 embodiment.

There are various alternative possibilities for the method of operation of the automatic or semi-automatic apparatuses for carrying out the process in accordance with the present invention, but each of them will involve the basic operating principle described above with reference to FIG. 1 and will enjoy the benefits of a maintained substantially uniform sub-atmospheric pressure during the steam shrinking step, thereby ensuring that the temperature of the steam is well below the boiling point of water and hence well below any temperature which it is likely to cause thermal damage to the heat-shrinkable film being processed.

I claim:

1. A method of making a package using a bag or pouch which is made from a heat shrinkable, flexible, thermoplastic material comprising the steps of:

a) filling the bag with a product;
b) evacuating the bag;
c) sealing the evacuated bag
d) reducing the pressure prevailing on the outside surface of the bag to below atmospheric pressure;
e) while maintaining said sub-atmospheric pressure, contacting the outside surface of the bag with steam generated under reduced pressure and at an initial temperature less than that required to generate steam at atmospheric pressure such that while under said sub-atmospheric pressure the steam will condense on the bag wall and its latent heat of condensation will transfer sufficient heat to the bag wall to shrink same; and, subsequently,
f) stopping flow of steam and restoring the pressure on the outside surface of the bag whereby a package made of heat shrunken material is produced.

2. The method of claim 1 wherein the step of contacting the outside surface of the bag with steam is performed before the pressure on the outside surface of the bag is reduced.

3. A method of making a packaging using containers such as a bag or pouch made of heat shrinkable, flexible, thermoplastic material which container has been filled with a product, evacuated and sealed, comprising the steps of:

a) placing at least one of said filled and sealed containers in a chamber,
b) closing the chamber and reducing the pressure within the chamber; and,
c) filling the chamber with steam generated under reduced pressure at an initial temperature less than that required to generate steam at atmospheric pressure and allowing the steam to condense upon the outside surface of the container whereby the latent heat of condensation of the steam will impart sufficient heat to the container to shrink same whereby a package made of heat shrunken material is produced.

* * * * *